US005656006A

United States Patent [19]

East et al.

[11] Patent Number: 5,656,006

[45] Date of Patent: Aug. 12, 1997

[54] METHOD AND APPARATUS FOR FORMING A WORK OBJECT

[75] Inventors: Blaine D. East, Fresno; Pete A. Montoya, Sanger, both of Calif.

[73] Assignee: SWF Machinery, Inc., Sanger, Calif.

[21] Appl. No.: 372,557

[22] Filed: Jan. 13, 1995

[51] Int. Cl.[6] ..... B31B 1/46

[52] U.S. Cl. ..... 493/171; 493/162

[58] Field of Search ..... 493/124, 125, 493/126, 127, 128, 130, 131, 141, 143, 151, 153, 152, 167, 162, 169, 170, 171, 132, 150, 149, 163, 168, 175

[56] References Cited

U.S. PATENT DOCUMENTS

| | | | |
|---|---|---|---|
| 1,160,990 | 11/1915 | Obenchain et al. . | |
| 2,614,466 | 10/1952 | Palmer . | |
| 2,925,758 | 2/1960 | Beetz | 493/167 |
| 3,260,174 | 7/1966 | Pierce | 493/167 |
| 3,492,923 | 2/1970 | Stenberg . | |
| 3,659,505 | 5/1972 | Wasyluka | 93/51 M |
| 4,052,933 | 10/1977 | Royal | 93/51 M |
| 4,345,905 | 8/1982 | Moen | 493/171 |
| 4,596,542 | 6/1986 | Moen | 493/89 |
| 4,857,038 | 8/1989 | Tacchini . | |
| 4,936,815 | 6/1990 | Kirkland et al. . | |
| 4,988,331 | 1/1991 | Boisseau | 493/171 |
| 5,024,641 | 6/1991 | Boisseau | 493/171 |
| 5,147,271 | 9/1992 | Bacques | 493/143 |
| 5,489,061 | 2/1996 | Fogle | 229/109 |

*Primary Examiner*—Joseph J. Hail, III
*Assistant Examiner*—Christopher W. Day
*Attorney, Agent, or Firm*—Worrel & Worrel

[57] ABSTRACT

A method for forming a work object including the steps of moving the work object, initially disposed in a first configuration, along a path of travel to a forming position; defining an outer boundary for the work object, disposed in a second configuration, substantially about said forming position; and expanding the work object, during moving of the work object along the path of travel, to dispose the work object in the second configuration in the forming position. An apparatus for forming a work object including a mechanism for delivering the work object, disposed in a first configuration, to a deliver position; a forming assembly adjacent to the delivery position defining a forming chamber dimensioned to receive the work object therewithin disposed in a second configuration; and a manipulating assembly operable to engage the work object in the delivery position and to transport the work object into the forming chamber to manipulate the work object from the first configuration to the second configuration.

30 Claims, 9 Drawing Sheets

METHOD AND APPARATUS FOR FORMING A WORK OBJECT

BACKGROUND OF THE INVENTION

1. Field of the Invention

The present invention relates to a method and apparatus for forming a work object and, more particularly, to such a method and apparatus which are particularly well suited to the manipulations required in the formation of containers and the like from preformed, flattened blanks of construction material.

2. Description of the Prior Art

A wide variety of industries are dependent upon the assembly and use of work objects in such volume and at such low cost as to require that such operations be fully mechanized. This is particularly true in the assembly and use of containers such as are, for example, used in the packing and shipping of commodities such as fresh fruits, fresh vegetables, canned goods, meat, and a wide assortment of other goods.

For many such industries, it has been found most efficient and otherwise effective to employ cardboard containers. Such containers are comparatively inexpensive, light in weight, sufficiently strong for the prescribed usage and disposable at the ultimate destination. Most prevalent in such use are corrugated cardboard containers which can be produced in a variety of shapes and sizes suited to the specific prescribed uses intended. Such corrugated cardboard containers are unusually strong and durable for their cost and weight and thus are excellently suited to serving a multitude of uses. Typically, the manufacturers of such containers produce them in flattened, blank type configurations. These are sold in bulk to users which employ container forming machines to form, or erect, the containers for use. Such users may, for example, be companies which pack and sell, or distribute, any of the aforementioned commodities.

A conventional container forming machine typically receives the container blanks in bulk in a hopper, or magazine. During operation, the machine feeds each blank in succession along a path of travel, applies adhesive at predesignated locations thereon, folds the container blank along preformed score lines and into designed container configurations, compresses portions of the container so that the adhesive adheres to retain the container in the designed configuration and finally discharges the container for use in packing the commodities involved. Such packing is normally also performed on an entirely automated basis by other equipment. It is essential in such container forming machines that the containers be formed and discharged at a high rate of speed to produce the volume of containers required during the packing operation. However, it is also required that the containers, so formed, be dependably of the design configuration required and without variation from container to container so that, for example, the packing equipment is capable of handling, packing and sealing the containers. Variation in these regards from container to container may well render such containers unsatisfactory for use because such mechanized packing equipment is dependent for proper operation in numerous respects on receiving containers only of the designated design configuration and dimensions.

The designs of the containers and, as a consequence, the designs of container forming machines, have become increasingly more sophisticated as technology has advanced. Concomitantly, the demands of the users of such containers for the production of containers of more complex designs better suited to particular uses have increased. Since corrugated cardboard containers are essentially paper and, therefore inherently fragile, there is a particular need in the certain industries for corrugated cardboard containers of greater overall strength and/or of reinforced construction in specific portions thereof. This is true, for example, of industries in which the commodities to be packed are comparatively heavy, or bulky, or irregularly shaped. Such products do not readily interfit with each other within the container when packed. As a consequence, such commodities tend to shift and to leave vacant areas within the container which may contribute to container collapse during packing, shipping, or handling by the end user. More specifically, for example, whole, as well as segmented, meat such as poultry, whether frozen or refrigerated, constitutes a comparatively heavy, bulky and irregularly shaped product which presents particular difficulties in this regard. This is true irrespective of the manner in which such commodities are individually packaged.

As a consequence, the packers, distributors and end users of such products have long sought corrugated cardboard containers which are stronger than have heretofore been available, as a practical matter, and/or reinforced in certain areas, and therefore more suited to the packing of such commodities. While a variety of designs have been created for corrugated cardboard containers of improved strength, their commercial acceptance has been severely limited due to the lack of satisfactory mechanized equipment for forming such containers for subsequent use. Such containers can be formed manually, but no mechanized equipment has existed which was capable of forming such containers in sufficient volume, at sufficient speed and with sufficient precision to make such containers practical for wide spread commercial adoption.

Therefore, it has long been known that it would be desirable to have a method and apparatus for forming a work object which have particular utility in the formation of containers; which possess the sensitivity, dexterity and speed required for the formation of cardboard containers of more sophisticated construction; which have the capability of forming cardboard containers from container blanks of a flattened configuration operating to receive the blanks and to fold the blanks into a predesignated configuration; which are unusually well suited to the formation of corrugated cardboard containers to be employed in the packing and shipment of commodities which are relatively heavy, or bulky, or irregularly shaped so that the packed container forms a more unitary mass less susceptible to collapse, or other damage; and which are otherwise entirely successful in achieving their operational objectives.

SUMMARY OF THE INVENTION

Therefore, it is an object of the present invention to provide an improved method and apparatus for forming a work object.

Another object is to provide such a method and apparatus which are particularly well suited to the formation of containers.

Another object is to provide such a method and apparatus which possess the sensitivity, dexterity and speed of operation required for the commercially practical formation of containers having configurations not of a conventional and otherwise regular type thereby permitting containers to be designed for commercial usage which are specifically intended for the packing of particular commodities having unusual requirements so as to avoid container failure and product loss during the packing, shipping, storing and handling thereof.

Another object is to provide such a method and apparatus which have particular utility in the formation of containers of the corrugated cardboard type employed in the packing of commodities such as fresh fruits and vegetables, canned goods, meat, such as poultry, whether frozen or refrigerated, and the like.

Another object is to provide such a method and apparatus which are entirely successful in achieving the formation of containers specifically designed for the packing and shipment of commodities which are relatively heavy, or bulky, or irregularly shaped, thereby presenting particular difficulties due to the formation of vacant areas within the packed containers, as well as shifting of the commodities within the container.

Another object is to provide such a method and apparatus which are particularly adept at the formation of corrugated cardboard containers having rectangular, substantially flat bottom panels and side and end panels interconnected by oblique, or beveled, corner panels.

Another object is to provide such a method and apparatus which, for the first time, permit the erection of corrugated cardboard containers having oblique or beveled corner panels in a volume, at a cost and with a dependability which are entirely commercially practical.

Another object is to provide such a method and apparatus which possess a simplicity of operation and a dependability of use not heretofore achieved in the art.

Further objects and advantages are to provide improved elements and arrangements thereof in an apparatus for the purpose described which is dependable, economical, durable and fully effective in accomplishing its intended purpose.

These and other objects and advantages are achieved, in the method and apparatus of the present invention, by a method including the steps of moving the work object, initially disposed in a first configuration, along a path of travel to a forming position; defining an outer boundary for the work object, disposed in a second configuration, substantially about the forming position; and expanding the work object, during moving of the work object along the path of travel, to dispose the work object in the second configuration in the forming position. Similarly, these and other objects and advantages are achieved in the apparatus of the present invention in a mechanism for delivering the work object, disposed in the first configuration to a delivery position; a forming assembly adjacent to the delivery position defining a forming chamber dimensioned to receive the work object therewithin disposed in a second configuration; and a manipulating assembly operable to engage the work object in the delivery position and to transport the work object into the forming chamber to manipulate the work object from the first configuration to the second configuration.

DESCRIPTION OF THE PREFERRED EMBODIMENT

Figure 1:
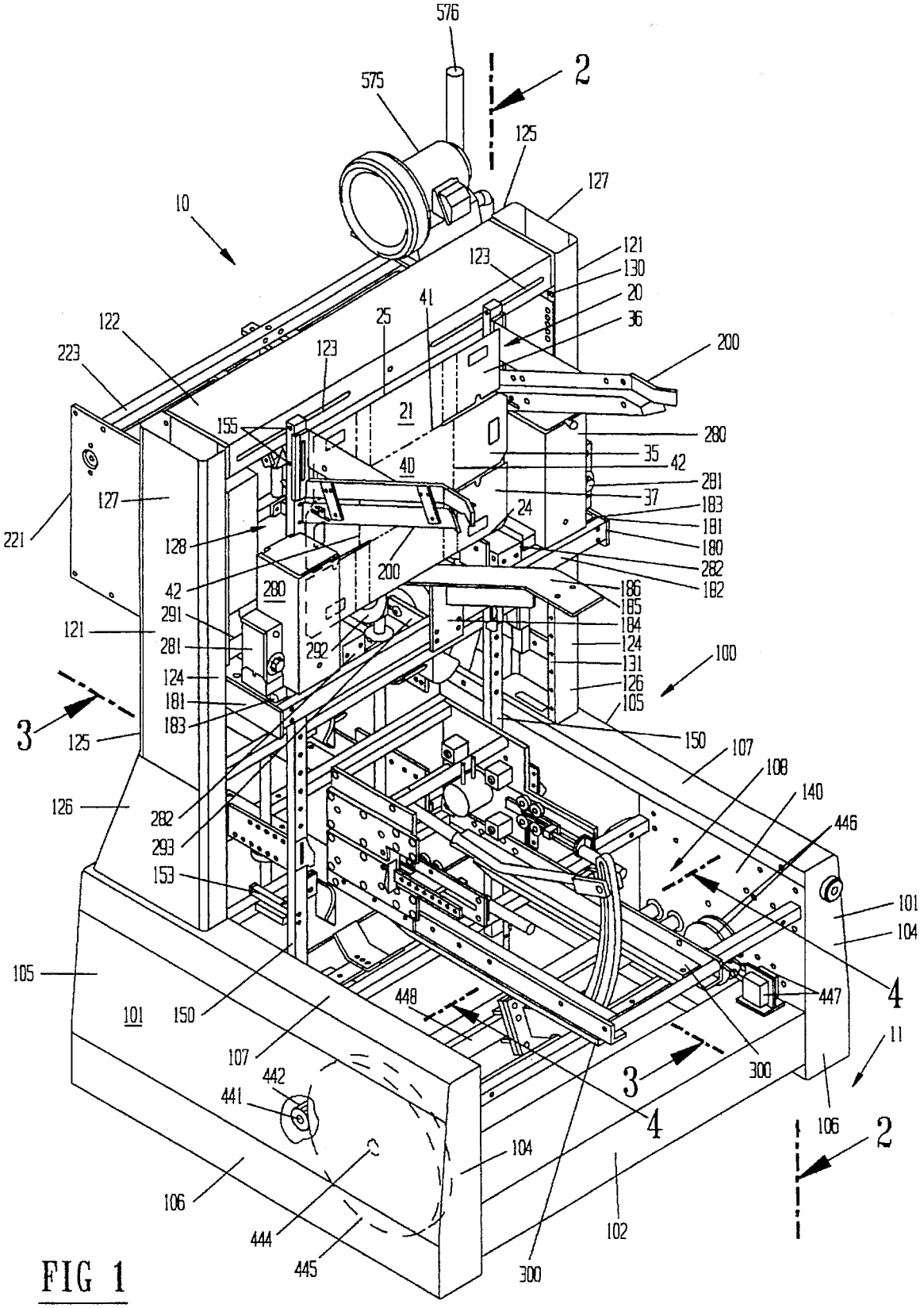
FIG. 1 is a perspective view of the apparatus for forming a work object of the present invention employed in the practice of the method of the present invention.

Referring more particularly to the drawings, the apparatus for forming a work object of the present invention is generally indicated by the numeral 10 in FIG. 1. As shown therein, the apparatus 10 is rested on a surface of support, such as for example a concrete floor, generally indicated by the numeral 11.

The method and apparatus of the present invention are operable to form a wide variety of work objects. However, the method and apparatus of the present invention are particularly well suited to the forming of containers from container blanks. For illustrative convenience, it will be understood that the container formed using the method and apparatus of the present invention is a corrugated cardboard container having oblique, or beveled, corner panels, as shown in FIG. 4C.

Figure 4A:
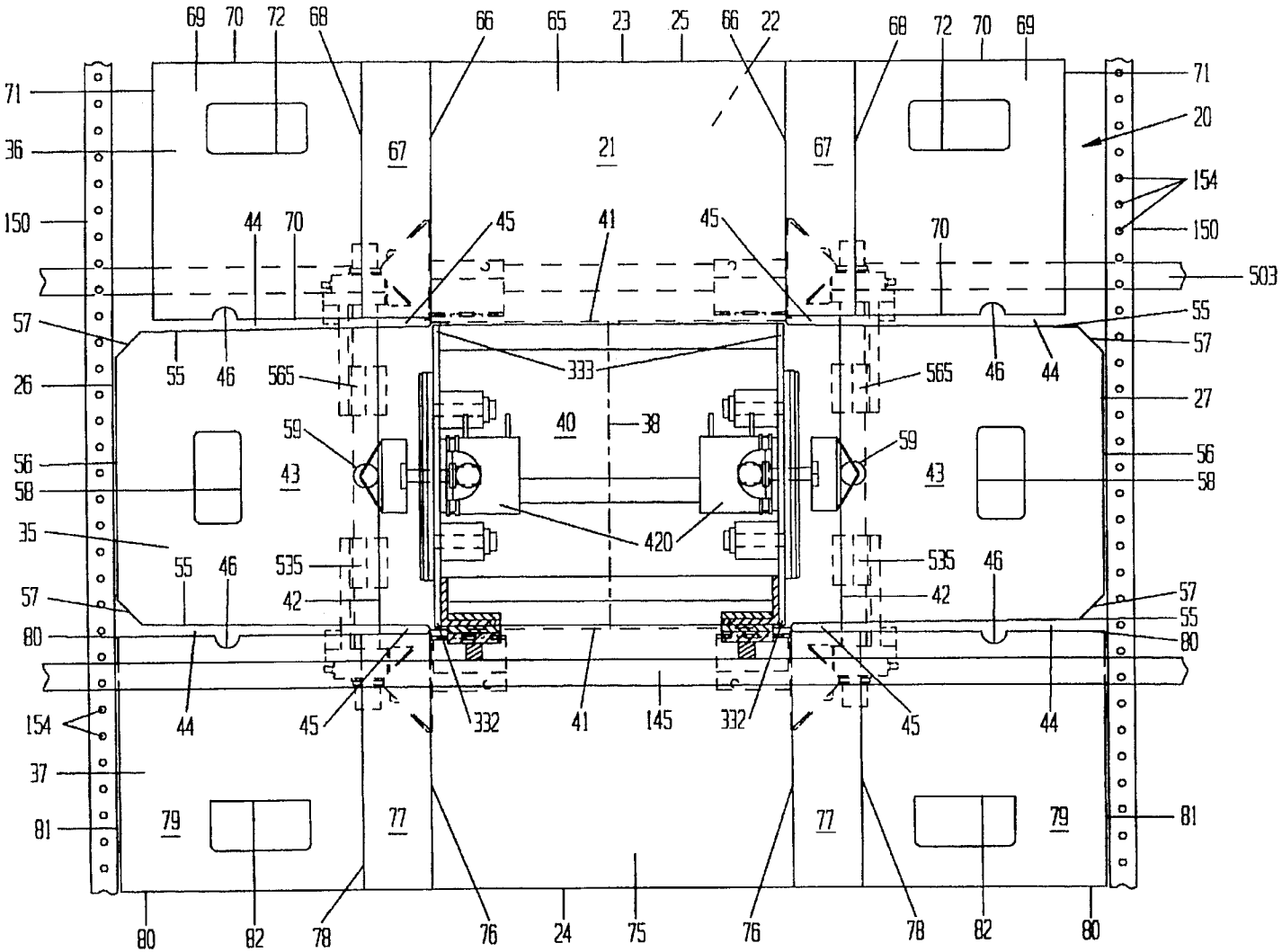
FIG. 4A is a fragmentary, transverse vertical section taken from a position indicated by line 4—4 in FIG. 1 and showing the mandrel assembly in a first, or retracted, position relative to a container blank and the forming assembly of the apparatus of the present invention.
Figure 4B:
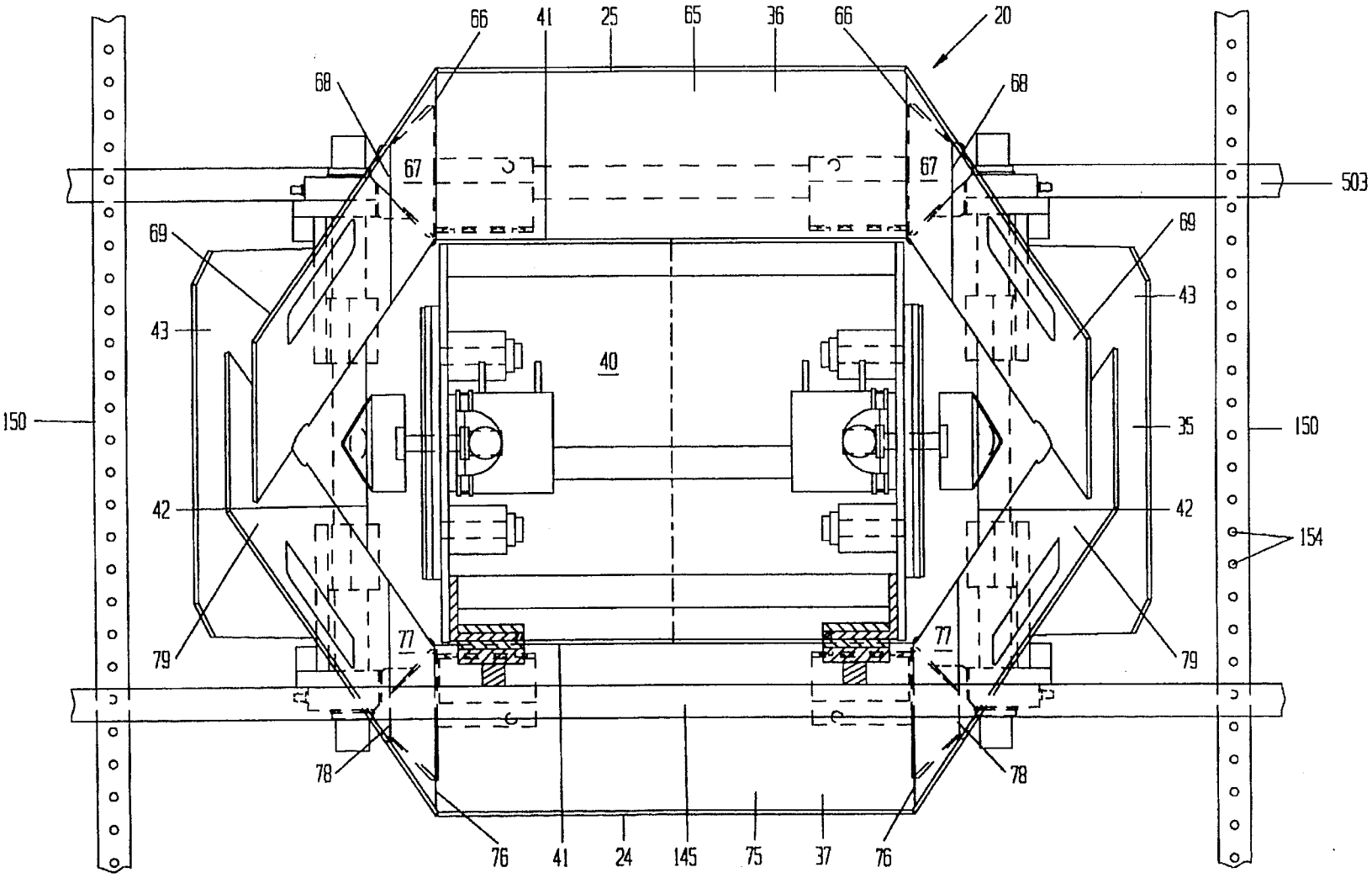
FIG. 4B is a somewhat enlarged, fragmentary, transverse vertical section taken from a position indicated by line 4—4 in FIG. 1 and showing the mandrel assembly, container blank and forming assembly of the apparatus of the present invention in a second operational position.
Figure 4C:
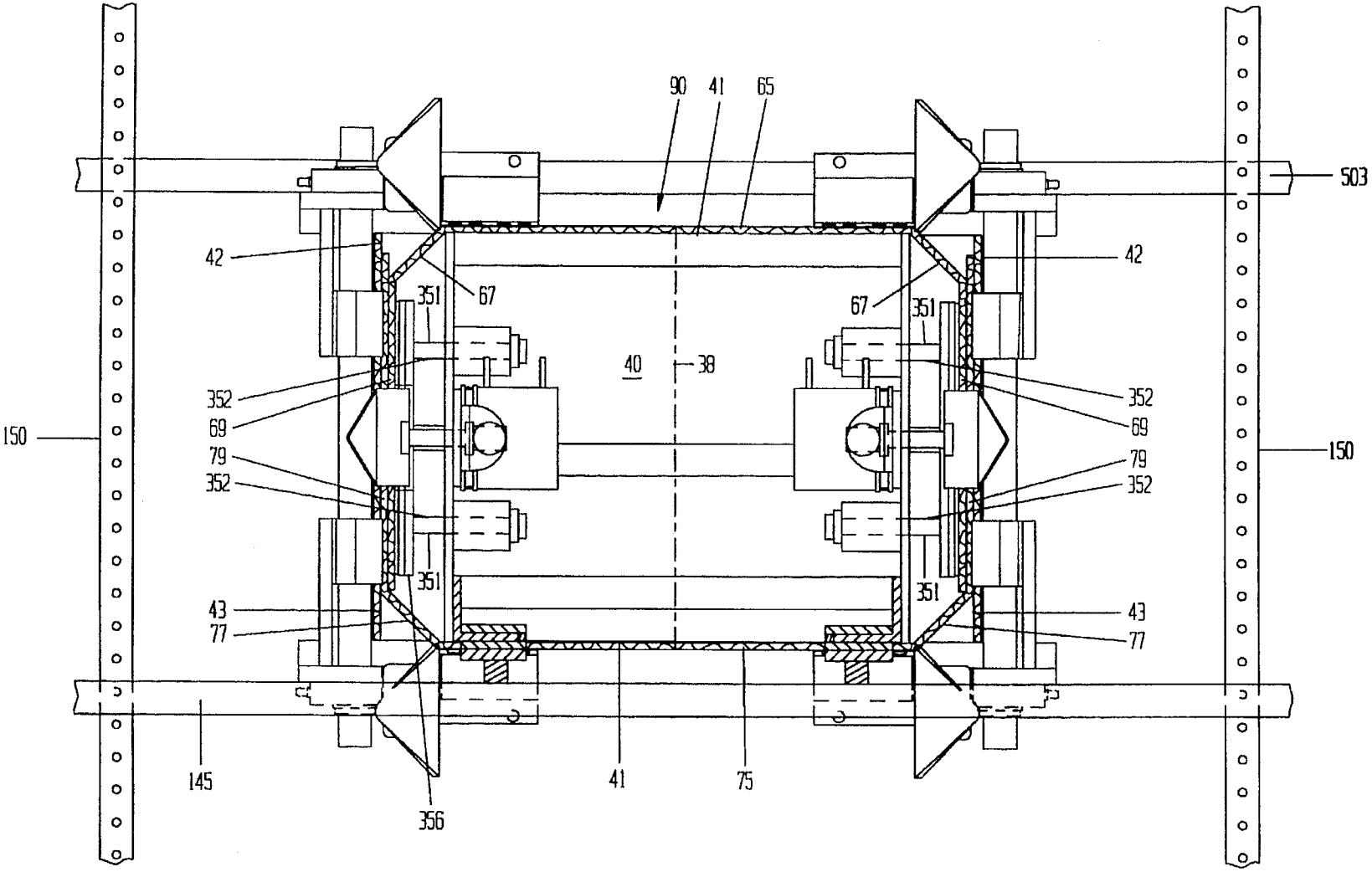
FIG. 4C is a fragmentary, transverse vertical section taken from a position indicated by line 4—4 in FIG. 1 and showing the mandrel assembly, container blank and forming assembly of the apparatus of the present invention in a third, or extended, operational position with the container in a fully assembled configuration as shown therein.

The container blank used in the formation of the container shown in FIG. 4C is generally indicated by the numeral 20 in FIG. 4A. As shown therein, the container blank is a substantially flat blank of a single layer of corrugated cardboard material having an interior surface 21 and an opposite, exterior surface 22. The container blank has an outer marginal edge 23 which is cut so as to form the portions thereof hereinafter described. The container blank has a lower edge 24 and an opposite, upper edge 25 both of which are substantially parallel to each other. The container blank has a left lateral edge 26 and an opposite fight lateral edge 27. The container blank may be viewed as having a central portion 35, an upper portion 36 and a lower portion 37 extending longitudinally of the container blank. The container blank may also be viewed as having a central axis of reference 38.

Turning then to the central portion 35 of the container blank 20, the central portion has a central, or bottom panel 40 separated from the upper and lower portions 36 and 37, respectively, by scorelines, or longitudinal edges 41. The bottom panel has scorelines, or transverse edges 42. End flaps 43 individually extend from the transverse edges 42 of the bottom panel to the left lateral edge 26 and fight lateral edge 27, respectively, of the central portion 35. The end flaps are each bounded by a pair of slots 44 which extend to terminal ends 45. Arcuate notches, or drain openings, 46 extend outwardly from the slots 44 relative to each end flap, as shown in FIG. 4A.

Each of the end panels 43 has lateral edges 55 forming boundaries to their respective slots 44. Each end panel has an end edge 56 and a pair of adjoining beveled edges 57. Each end flap has a hand opening 58 and a drain hole 39 extending therethrough.

Referring more particularly to the upper portion 36 of the container blank 20, the upper portion has an upper or side panel 65. Each side panel is bounded by a pair of parallel interior scorelines or vertical edges 66. It may be noted from FIG. 4A that the vertical edges 66 are inwardly oriented relative to the transverse edges 42 of the bottom panel 40. Individually extending outwardly from the vertical edges 66 are corner panels 67. An outer score line or vertical edge 68 extends across the upper portion 36 parallel to each vertical edge 66 so as to bound each corner panel 67. An end flap 69 extends outwardly from each vertical edge 68 and is bounded by parallel lateral edges 70. Each end flap has an end edge 71 right-angularly related to the lateral edges 70. A hand opening 72 extends through each end flap, as shown in FIG. 4A.

The lower portion 37 of the container blank 20 has a lower or side panel 75 bounded by interior scorelines or vertical edges 76 aligned with the vertical edges 66 of the side panel 65. Corner panels 77 individually extend outwardly from the vertical edges 76 of the side panel 75 to outer scorelines or vertical edges 78, parallel to the vertical edges 76. End flaps 79 extend outwardly from the vertical edges 78 and are bounded by lateral edges 80. The end flaps individually extend to individual end edges 81 right-angularly related to their lateral edges 80.

Referring more particularly to FIG. 4C, the erected container constructed, using the method and apparatus of the present invention, is generally indicated by the numeral 90.

Figure 2:
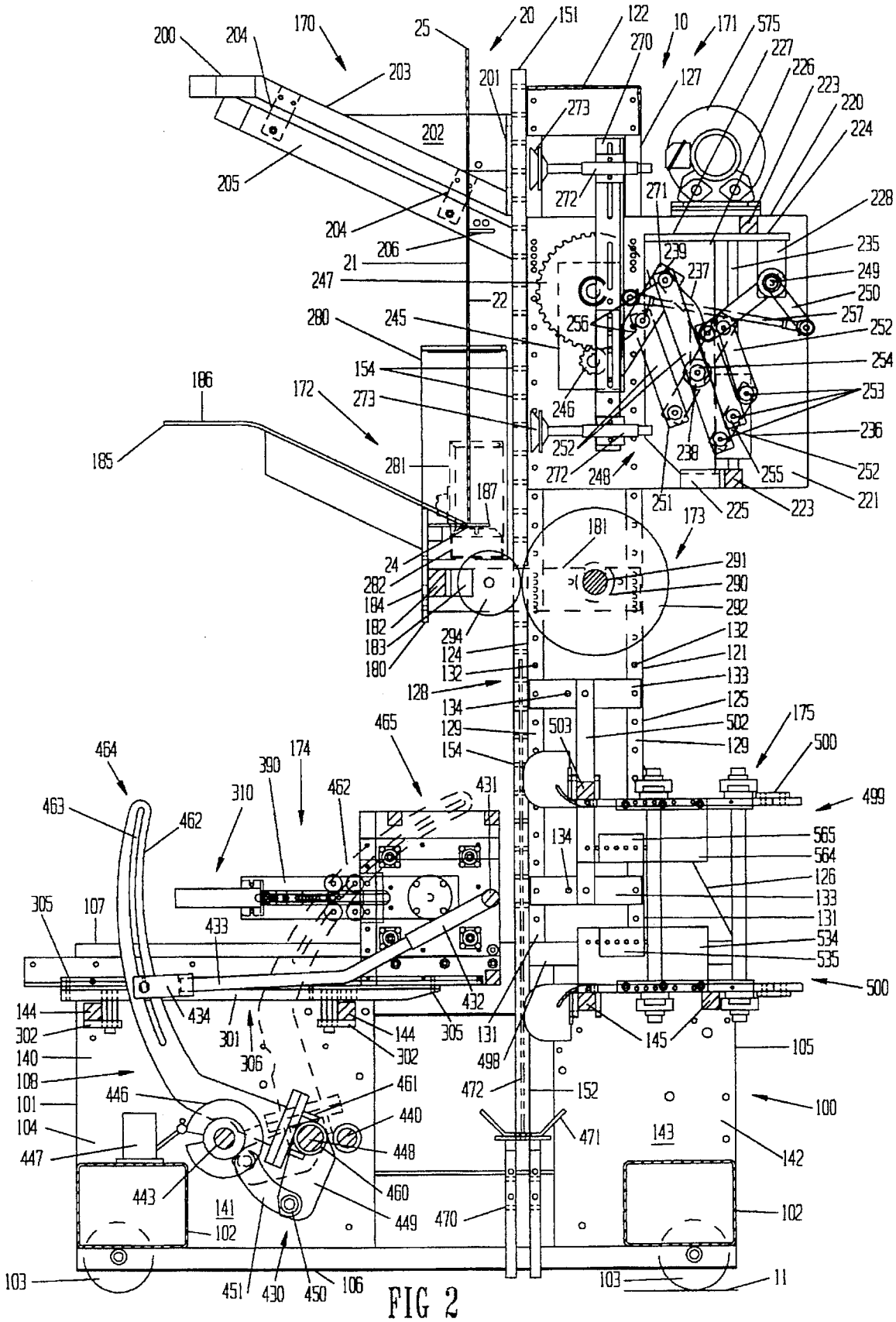
FIG. 2 is a somewhat enlarged, longitudinal vertical section taken from a position indicated by line 2—2 in FIG. 1.

The apparatus 10 of the present invention has a main frame generally indicated by the numeral 100 in FIG. 2. As shown best in FIG. 1, the main frame has a pair of lower side housings 101. The lower side housings are interconnected by a pair of tubular main beams 102 extending in fight angular relation to and between the lower side housings. A pair of wheel assemblies 103 are mounted on each of the lower side housings 101 to support the main frame 100 for movement on the surface of support 11 for purposes, for example, of positioning the main frame relative to other equipment. The lower side housings have forward portions 104 and opposite rearward portions 105. The lower side housings have lower portions 106 and opposite upper portions 107. The area between the lower side housings constitutes a lower work station 108.

The main frame 100 has a pair of upper side housings 121 individually mounted on the lower side housings 101 adjacent to the rearward portion 105 thereof and extending vertically upwardly therefrom. The upper side housings are interconnected by an upper main beam 122 extending therebetween in right angular relation to the upper side housings. A pair of tracks, or slots, 123 extend through the upper main beam on the portion thereof facing the forward portions 104 of the lower side housings 101. The slots are disposed in the same horizontal plane. The upper side housings each have forward portions 124 and opposite rearward portions 125. The upper side housings have lower portions 126 and opposite upper portions 127. The area between the upper side housings constitutes an upper work station 128. Facing the upper work station, each upper side housing mounts a pair of vertical mounting plates 129 extending vertically substantially the entire length thereof in spaced, parallel relation, as best shown in FIG. 2. The mounting plates have upper end portions 130 and opposite lower end portions 131. Each of the mounting plates is pierced by a plurality of mounting holes 132 extending through their respective mounting plate and disposed in vertical alignment. A pair of transverse mounting plates 133 are mounted on and interconnect the vertical mounting plates 129 in spaced, parallel relation, as best shown in FIG. 2. Each transverse mounting plate is pierced by a plurality of mounting holes 134 extending therethrough and disposed in horizontal alignment.

Each of the lower side housings 101 mounts a forward mounting plate 140 facing the lower work station 108, as best shown in FIG. 2. Each of the forward mounting plates has an interior surface 141. Each of the lower side housing mounts a rearward mounting plate 142 facing the lower work station 108 and having an interior surface 143, as best shown in FIG. 2. The forward mounting plates are interconnected by a pair of forward support bars 144 extending therebetween in parallel relation to each other and fight angular relation to the forward mounting plates adjacent to the upper portions 107 of the lower side housings. The rearward mounting plates 142 are interconnected by a pair of rearward support bars 145 extending therebetween in parallel relation to each other and fight angular relation to the rearward mounting plates and at a slightly higher elevation than the forward support bars 144.

As shown in FIG. 1, a pair of vertical support bars 150 are mounted on the main frame 100 in spaced relation extending parallel to each other and individually vertically oriented. Each of the vertical support bars has an upper end portion 151 mounted on the upper main beam 122 by an adjustable assembly, not shown, individually extending through and adjustably secured on its respective slot 123. Each of the vertical support bars has a lower end portion 152 adjustably mounted on the forward most rearward support bar 145 by a suitable mounting assembly 153. A plurality of mounting passages 154 extend through each vertical support bar aligned in vertically spaced relation. A plurality of transverse mounting passages 155 extend through the upper end portion 151 of each vertical support bar, as best shown in FIG. 1.

A blank magazine or hopper assembly is mounted on the vertical support bars 150 and generally indicated by the numeral 170 in FIG. 2. A blank feeding assembly generally indicated by the numeral 171 is mounted on the upper side housings 121 in the upper work station 128. An adhesive applying assembly is generally indicated by the numeral 172 in FIG. 2 mounted on the vertical support bars 150, as will hereinafter be described. A blank drive assembly is generally indicated by the numeral 173 in FIG. 2 mounted in the upper work station beneath the blank hopper assembly 170 and the blank feeding assembly 171. A mandrel assembly is generally indicated by the numeral 174 in FIG. 2 mounted in the lower work station 108 between the lower side housings 101. A forming assembly is generally indicated by the numeral 175 in FIG. 2 mounted on the rearward support bars 145.

Blank Hopper Assembly

The blank hopper assembly 170 includes and is borne by a support frame 180, best shown in FIG. 2. The support frame has a pair of support arms 181 individually mounted on the vertical mounting plates 129 of each upper side housing 121 and extending horizontally forwardly therefrom. The support arms of the respective upper side housings are interconnected by a cross member 182 individually mounted at its opposite ends on the support arms 181 by brackets 183. A support plate 184 is mounted on the cross member 182 centrally thereof between the support arms 181 and extending upwardly therefrom. A ramp assembly 185 is mounted on the support plate 184 and extends forwardly and upwardly therefrom. The ramp assembly has a smooth upper surface 186, as best shown in FIG. 2. The ramp assembly extends rearwardly to a horizontal portion and terminates in a blank release edge 187 which is horizontally disposed centrally of and midway between the support arms 181, as best shown in FIGS. 1 and 2.

The blank hopper assembly 170 has a pair of upper guide arm assemblies 200. Each of the upper guide arm assemblies has a mounting plate 201 from which is extended a support plate 202, as best shown in FIG. 2. An upper guide arm 203 is mounted on the support plate 202 and the mounting plate 201 extending upwardly and forwardly as shown in FIG. 2. The upper guide arms are spaced from each other, as best shown in FIG. 1, to define a distance therebetween which is the same as the distance between the end edges 56 of the end flaps 43 of the container blank 20. A pair of brackets 204 are mounted on each upper guide arm 203 extending downwardly therefrom in spaced relation. A lower guide arm 205 is mounted on the brackets 204 of each upper guide arm with the brackets retaining the lower guide arms 205 in inwardly spaced relation to the upper guide arms so that the interior surfaces of the lower guide arms 205 are spaced from each other a distance equivalent to the distance between the end edges of the end flaps 43 of the container blank 20. A blank retention blade 206 is mounted on the interior surface of each lower guide arm in the positions indicated in FIG. 2 upwardly spaced from the blank release edge 187.

Blank Feeding Assembly

The blank feed assembly 171 of the apparatus 10 has a support frame 220, as shown in FIG. 2. The support frame includes a pair of side plates 221 individually mounted on the vertical mounting plates 229 of the upper side housings 221 and extending rearwardly therefrom in parallel relation to each other. The side plates are interconnected by a pair of horizontal cross members 223 extending therebetween in parallel relation to each other and in right angular relation to their respective side plates. Interior frame 224 is mounted on the upper cross member 223. The interior frame has a base member 225 which is mounted on a lower cross member 223. A plate 226 is mounted on and interconnects the interior frame 224 and base member 225. A top plate 227 is mounted on the plate 226 and is mounted, in turn, on the upper cross member 223. A pivot mounting plate 228 is mounted the top plate 227 extending downward therefrom substantially midway between and behind the side plates 226.

A guide shaft 235 is mounted on and interconnects the top plate and a lower cross member 223. A follower 236 is mounted for slidable movement on the guide shaft 235. An arcuate cam way 237 extends through one of the plates 226 and extends from a lower end 238 to an upper end 239.

A gear mount 245 is mounted on one of the side plates 221 and, in turn, rotationally mounts a smaller drive gear 246 in driving engagement with a larger drive gear 247. The blank feeding assembly 171 further includes a cup extension assembly generally indicated by the numeral 248 between the side plates 221. The cup extension assembly includes a pivot 249 mounted on the pivot mounting plate 228 for pivotal movement of a lever arm 250 mounted thereon. A linkage 251 is mounted on and extends from the lever arm and includes a plurality of link members 252 pivotally interconnected by pivotal interconnections 253, as shown in FIG. 2. The linkage includes a cam follower 254 borne by one of the link members 252 and received in the arcuate cam way 237 for movement therealong as will hereinafter be described. A link pin 255 extends from one of the pivotal interconnections and is connected to the follower 236 mounted for slidable movement on the vertical guide shaft 235. The linkage extends to two (2) terminal end portions 256. A linking arm 257 interconnects larger drive gear 247 and lever arm 250.

A cup frame 270 includes a mounting arm 271 pivotally mounted on the terminal end portions 256 of the linkage 251 extending substantially downwardly and forwardly therefrom. The mounting arm has cup mounting assemblies 272 mounted thereon, as shown in FIG. 2 and mounts preferably four (4) vacuum cups 273 thereon defining, in effect, a vertical plane of engagement with a work object, as will hereinafter be described. The vacuum cups are operatively connected to a vacuum system of any suitable type, not shown.

Adhesive Applying Assembly

The adhesive applying assembly 172 is substantially conventional and is best shown in FIGS. 1 and 2. The adhesive applying assembly has a pair of adhesive reservoirs 280 within which temperature is controlled by individual thermostatically controlled heating units 281. The adhesive reservoirs are adapted to dispense heated adhesive to the adhesive dispensing assembly 282 extended therefrom. The adhesive dispensing assemblies, as previously described, are entirely conventional. However, for purposes of illustrative convenience, it will be understood that the adhesive dispensing assemblies 282 dispense adhesive along predetermined courses to the right thereof as shown in FIG. 2.

Blank Drive Assembly

The blank drive assembly 173 of the apparatus 10 includes a pair of bearing assemblies 290 individually mounted on the support arms 181 between the vertical mounting plates 129 of each upper side housing 121 defining an axis of rotation extending horizontally therebetween. A drive shaft 291 is journaled in the bearing assemblies 290 extending therebetween. A drive wheel 292 is mounted on the drive shaft for rotational movement thereby about the axis of rotation of the drive shaft defined by the bearing assemblies. An idler wheel mount 293 is mounted on and extends from the cross member 182 of the support frame 180 toward the drive wheel 292. An idler wheel 294 is mounted on the idler wheel mount for rotational movement about an axis of rotation parallel to the axis of rotation defined by the beating assemblies 290 and with the idler wheel in driven engagement with the periphery of the drive wheel 292.

Mandrel Assembly

Figure 3:
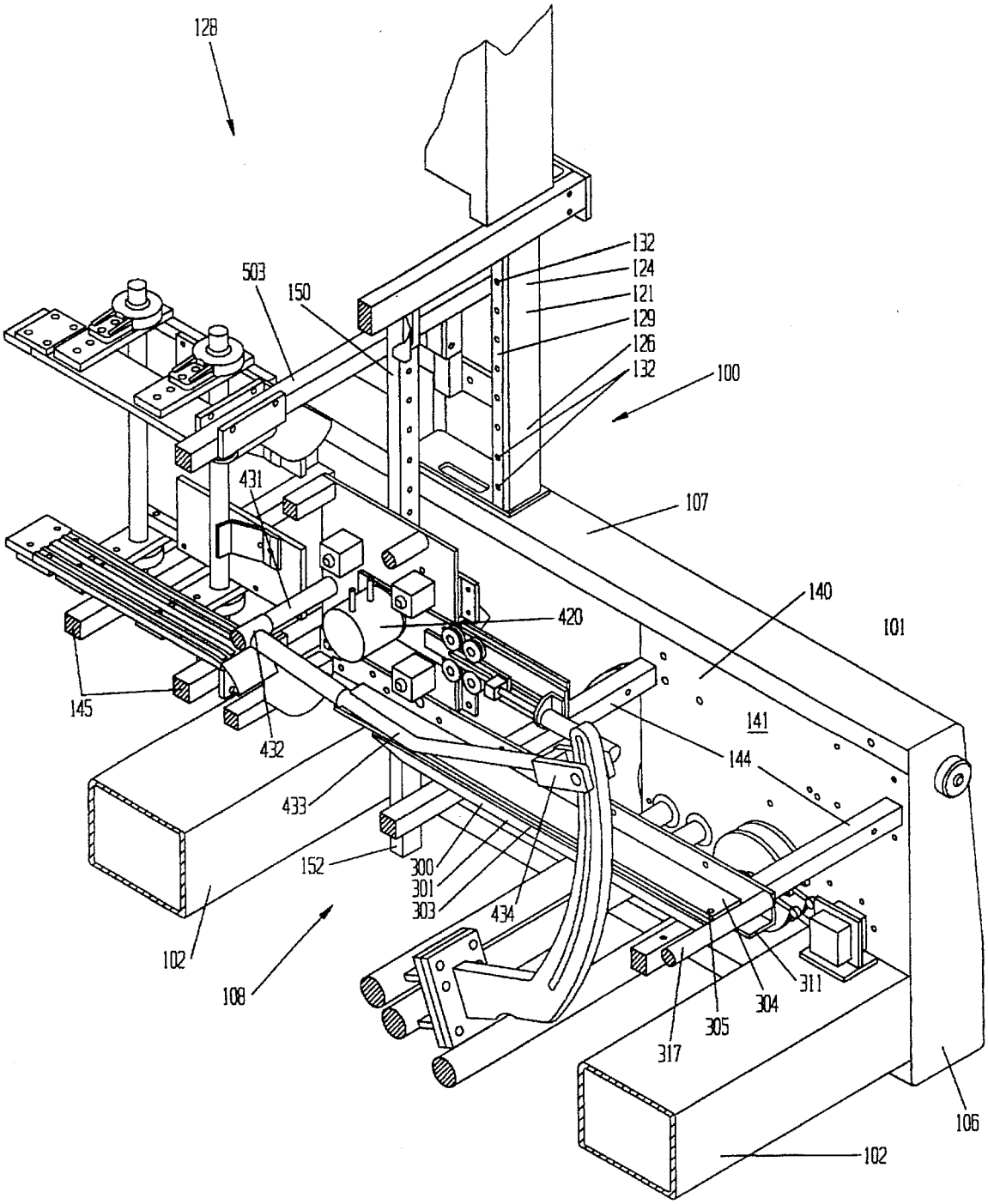
FIG. 3 is a somewhat further enlarged, fragmentary, longitudinal perspective view taken from a position indicated by line 3—3 in FIG. 1.
Figure 6:
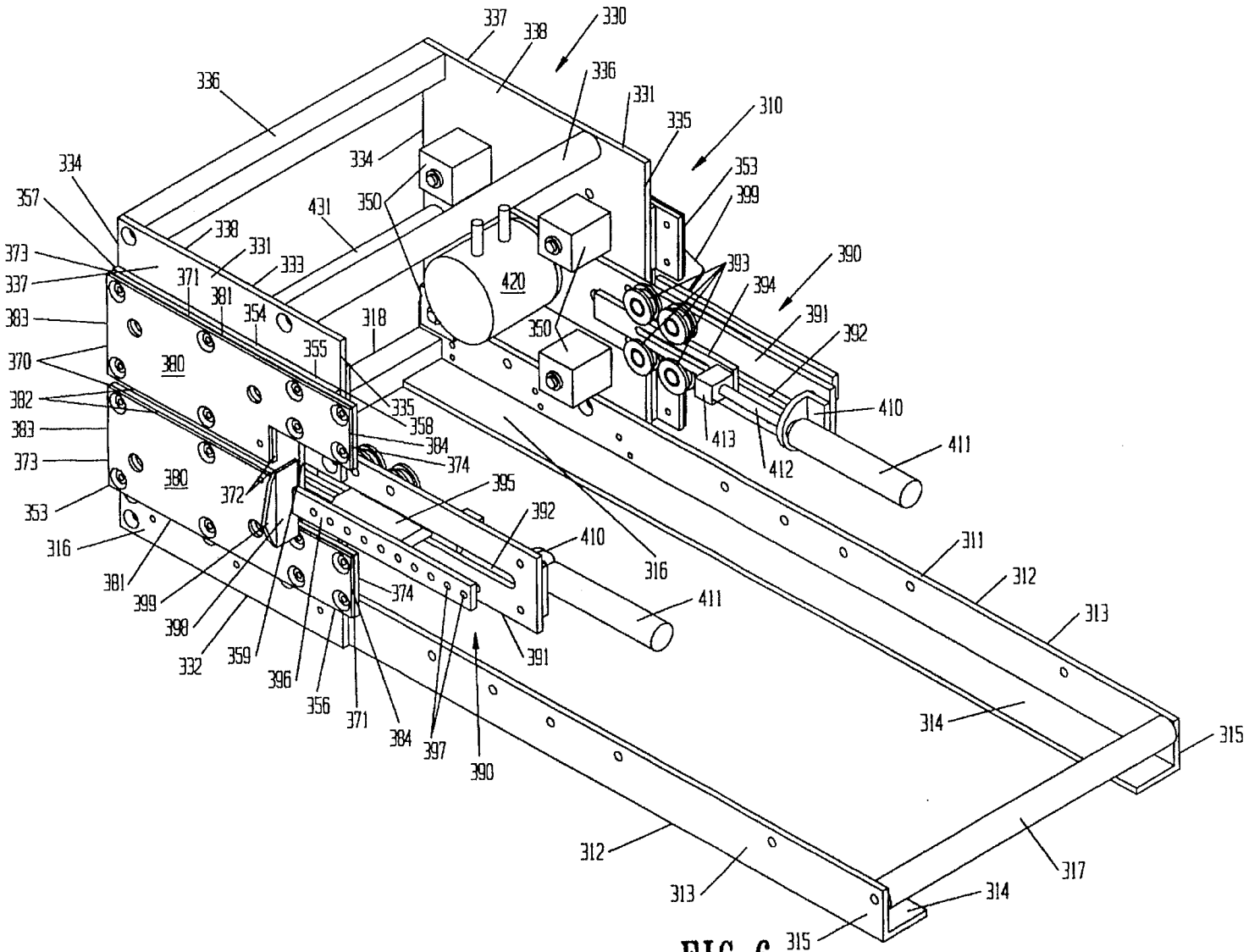
FIG. 6 is a somewhat enlarged, fragmentary perspective view of the mandrel assembly of the apparatus of the present invention.

The mandrel assembly 174 of the apparatus 10 is, perhaps, best shown in FIGS. 2, 3 and 6. The mandrel assembly includes a pair of guide rail assemblies 300 mounted on the forward support bars 144 in predetermined spaced, substantially parallel relation to each other and in right angular relation to the forward support bars 144. Referring more particularly to FIG. 2, each of the guide rail assemblies has a base plate 301 having a pair of mounting bracket assemblies 302 individually, adjustably mounting the base plate on the forward support bars 144. As shown in FIG. 3, a bearing plate 303 is mounted on each base plate and is preferably constructed of a material having a low coefficient of friction. An upper plate 304 is mounted in spaced relation to the beating plate and thereabove by a plurality of fasteners 305. The spaces between the upper plates 304 and the bearing plates 303 of the guide rail assemblies thus define a track, or path of travel, 306 for the mandrel assembly which is horizontal and extends from the left of the apparatus to the right of the apparatus, as viewed in FIG. 2, for the mandrel assembly for slidable movement therewithin.

The mandrel of the mandrel assembly 174 is generally indicated by the numeral 310 and is best shown in FIG. 6. The mandrel has a reciprocating frame 311 including a pair of angle members 312 individually slidably received in the guide rail assemblies 300. Each of the angle members has a vertical portion 313 and a horizontal portion 314. The horizontal portions 314 of the angle members are individually slidably received between the beating plates 303 and the upper plates 304 of the respective guide rail assemblies for slidable movement therebetween. Each of the angle members has a rear end portion 315 and an opposite front end portion 316. The angle members are interconnected by a rear cross member 317 and a front cross member 318. Thus, the angle members interconnected by the rear and front cross members form the reciprocating frame 311.

A mandrel head assembly 330 is mounted on the reciprocating frame 311 of the mandrel 310, as best shown in FIG. 6. The mandrel head assembly has a pair of main plates 331 individually mounted on the angle members 312 extending rearwardly from the front end portions 316 thereof and extending upwardly from the vertical portions 313 thereof in spaced parallel relation. The main plates extend from lower edges 332 to upper edges 333. The main plates extend from front edges 334 to trailing edges 335. The main plates are interconnected by upper cross members 336 extending in spaced, parallel relation as best shown in FIG. 6. The main plates have outer surfaces 337 and opposite inner surfaces 338.

As shown in FIG. 6, each of the main plates 331 mounts four (4) bearing housings 350 on the inner surface 338 thereof. Each of the bearing housings mounts a mounting shaft 351 for slidable movement therewith. Each mounting shaft has a terminal end portion 352. An expansion plate assembly 353 is mounted on the terminal end portions of the mounting shafts 351 of each of the main plates 331. Each of the expansion plate assemblies includes an interior plate 354 which is mounted on the terminal end portions 352 of the mounting shafts 351 disposed in spaced, parallel relation to its respective main plate 331. The interior plate has an upper edge 355 downwardly spaced relative to the upper edge 333 of its respective main plate. Similarly, the interior plate has a lower edge 356 which is upwardly spaced a predetermined distance from the lower edge of its respective main plate 331. Similarly, the interior plate has a forward edge 357 right-angularly related to the upper and lower edges and a trailing edge 358 having a notch 359 therein.

A pair of central plates 370 are individually mounted on each interior plate 354 and, as shown in FIG. 6, have distal edges 371 and juxtaposed proximal edges 372. The central plates have leading edges 373 in the same plane as that defined by the front edges 334 of the mandrel head assembly 330. The central plates have trailing edges 374.

Face plates 380 are individually mounted on each of the central plates 370 in covering relation thereto. The face plates are preferably fabricated from a material having a low coefficient of friction. The face plates have distal edges 381 disposed in alignment with the distal edges 371 of the central plates and adjacent, parallel proximal edges 382 aligned with the proximal edges 372 of the central plates. The face plates have leading edges 383 which are aligned with the front edges 334 of the mandrel head assembly 330. The face plates have trailing edges 384 which are aligned with the trailing edges 374 of their respective central plates 370.

The mandrel 310 mounts a pair of pusher plate assemblies 390, as best shown in FIG. 6. Each of the pusher plate assemblies includes an interior mounting plate 391 which is itself mounted on the inner surface 338 of each of the main plates 331 and extends rearwardly therefrom in a predetermined position and parallel to its corresponding interior mounting plate 391. Each interior mounting plate has a slot 392 extending horizontally from a position within the notch 359 of the interior plate 354 to a point immediately adjacent to the trailing end of the interior mounting plate. A pair of guide wheel assemblies 393 are mounted on the interior surface of each interior mounting plate on opposite sides of the slot in predetermined spaced relation to each other.

A travel member 394 is received within and between the pairs of guide wheel assemblies for reciprocal movement as guided thereby along a horizontal path of travel. A travel plate 395 is mounted on each travel member extending horizontally through its respective adjacent slot 392 outwardly and laterally of the interior mounting plate and disposed for travel within its respective slot during the reciprocal movement of the travel member 394. A mounting plate 396 is mounted on the remote end of the travel plate outwardly of the interior mounting plate 391 and parallel thereto for reciprocal movement with the travel member and travel plate laterally of the expansion plate assemblies 353. The mounting plate has a plurality of mounting holes 397 extending therethrough and through which bolts are selectively extended to mount each mounting plate on its respective travel plate thereby permitting the mounting plate to be repositioned at any desired location longitudinally thereof relative to the travel plate, for purposes subsequently to be described. A pusher plate 398 is mounted on the forwardly extending end of each mounting plate extending laterally of the mounting plate and of the expansion plate assembly in right angular relation to the expansion plate assembly. The pusher plate has a tongue portion 399 at the outwardly extending edge thereof which is deployed at a slight angle relative to the pusher plate extending slightly backwardly from the pusher plate.

A pneumatic cylinder mount 410 is mounted on the interior side of each interior mounting plate 391 immediately adjacent to the rearwardly extending end thereof, as shown in FIG. 6. A pneumatic cylinder 411 is mounted on each pneumatic cylinder mount and has a pneumatic cylinder arm 412 extending therefrom forwardly toward the mandrel head assembly 330. The pneumatic cylinder arm is connected to the travel member 394 by a mount 413 interconnecting the pneumatic cylinder arm and the rearward end of the travel member. Thus, it will be seen that the pneumatic cylinders 411 are operable to move the travel member 394 and, thus, the pusher plate 398, in reciprocal motion along the path of travel bounded by the slot 392 toward and from the mandrel head assembly 330.

A pneumatic cylinder 420 is mounted on the forward portion of each interior mounting plate 391 and mounts a pneumatic cylinder arm 421 extending through the interior mounting plate, the main plate 331 and is mounted on the interior plate 354 of the expansion plate assembly 353. Thus, it will be seen that the pneumatic cylinder 420 is operable to move the pneumatic cylinder arm 421 to move its respective expansion plate assembly 353 from a retracted position, in facing engagement with its respective main plate 331, through positions of parallelism therewith outwardly from the main plate to the extended position shown in FIG. 4C.

The apparatus 10 has a mandrel driving assembly generally indicated by the numeral 430 in FIG. 2. The mandrel driving assembly includes a cross shaft 431 mounted on, and interconnecting, the main plates 331 of the mandrel head assembly 330 in right angular relation thereto. A pivot sleeve 432 is pivotally mounted on the cross shaft mid way between the main plates. A drive arm 433 is mounted on the pivot sleeve and extends rearwardly therefrom in right angular relation thereto to a clevis 434. The drive arm has an angle therein, as best shown in FIG. 2.

The mandrel driving assembly 430 includes a first drive shaft 440 individually journaled in bearings, not shown, individually mounted on the forward mounting plates 140 and defining an axis of rotation parallel to the forward support bars 144. The first drive shaft has an end portion, not shown, on the right of the apparatus 10, as viewed in FIG. 1, which is driven in a counterclockwise direction, as viewed in FIG. 1, from a suitable motor, not shown. The first drive shaft has an end portion 441 on which is mounted a gear 442.

A second drive shaft 443 is mounted for rotational movement in bearings, not shown, individually mounted on the mounting plates 140 about an axis of rotation parallel to the axis of rotation of the first drive shaft 440. The second drive shaft has an end portion 444 on which is mounted a gear 445 which is enmeshed in driven relation with gear 442. The interior surface of the gear 445 has a cam way, not shown, extending about the axis of rotation of the second drive shaft and gear defining a path of travel for a cam follower received therein. A pair of cams 446 are mounted in side by side relation on the second drive shaft in controlling contact with a pair of switches 447 of an electrical control system, not shown.

A third drive shaft 448 is journaled in a pair of bearings, not shown, individually mounted on the forward mounting plates 140 defining an axis of rotation between and parallel to the first drive shaft 440 and second drive shaft 443. The third drive shaft mounts a lever arm 449 mounting a cam follower 450 at the end portion thereof extending through a slot 451 in the adjacent forward mounting plate 140 and received in the cam way, not shown, of gear 445. Thus, it will be seen that rotation of the gear 445 causes the third drive shaft to be reciprocated in an arcuate path of travel as controlled by the cam follower 450 in the cam way of gear 445.

A mounting sleeve 460 is mounted on the third drive shaft 448 for pivotal movement therewith. A mounting assembly 461 is mounted, as by welding, on the mounting sleeve and, in turn, mounts a lever arm 462 extending substantially arcuately upwardly therefrom, as shown in FIG. 2. The lever arm has a slot 463 therein to which the clevis 434 of the drive arm 433 is attached. The clevis can be secured on the lever arm at any desired point along the slot 463 to select the distance of travel of the mandrel assembly 174 along the path of travel 306. The slot is preferably concentric to the axis of the cross shaft 431. The lever arm is movable from a retracted position, generally indicated by the numeral 464 in FIG. 2 and shown in full lines therein, to an advanced position, generally indicated by the numeral 465 shown in phantom lines in FIG. 2.

A support assembly 470 is mounted on the main frame 100 extending between the lower side housings 101 thereof in vertical alignment beneath the interface between the peripheral surface of the drive wheel 292 and the peripheral surface of the idler wheel 294. The support assembly mounts an upwardly facing stop plate 471 which has an upwardly facing, generally concave upper surface. The vertical space between the stop plate 471 and the interface between the peripheries of the drive wheel 292 and the idler wheel 294 constitute a delivery position or engagement work station or position 472.

Forming Assembly

The forming assembly 175 of the apparatus 10 has an entrance opening 498 and an opposite discharge opening 499. The forming assembly has a forming assembly frame 500 which may best be visualized upon reference to FIG. 5. The forming assembly frame has a pair of subassemblies 501. The subassemblies of the forming assembly frame are mounted on, and supported by, vertical mounting plates 502, as hereinafter described. A vertical mounting plate 502 is mounted on and interconnects the transverse mounting plates 133 of each upper side housing 121. Thus, the vertical mounting plates are disposed in parallel relation aligned transversely of the apparatus. An upper support bar 503 is mounted on and interconnects the vertical mounting plates 502 from positions mid way between the transverse mounting plates 133 of each upper side housing.

Each subassembly 501 of the forming assembly frame 500 mounts a lower shoe or ski member 520. The lower ski member of each subassembly has a forward or entrance portion 521 which curves downwardly and a rearward, or discharge portion 522, which is substantially flat. The lower ski member has an upper surface 523 preferably fabricated from a material having a low coefficient of friction. Each lower ski member has a lower surface 524. A pair of forward mounting brackets 525 are mounted on the lower surface 524 of the entrance portion 521 of each lower ski member. The mounting brackets 525 of the lower ski members are mounted on the rearward support bar 145 nearest the delivery position 472. The forward mounting brackets and, thus, the lower ski members, are mounted on the rearward support bar 145 in predetermined spaced relation to each other. The lower surface 524 of each lower ski member is rested on the rearward support bar 145 nearest the rearward portions 105 of the lower side housings 101.

Figure 5:
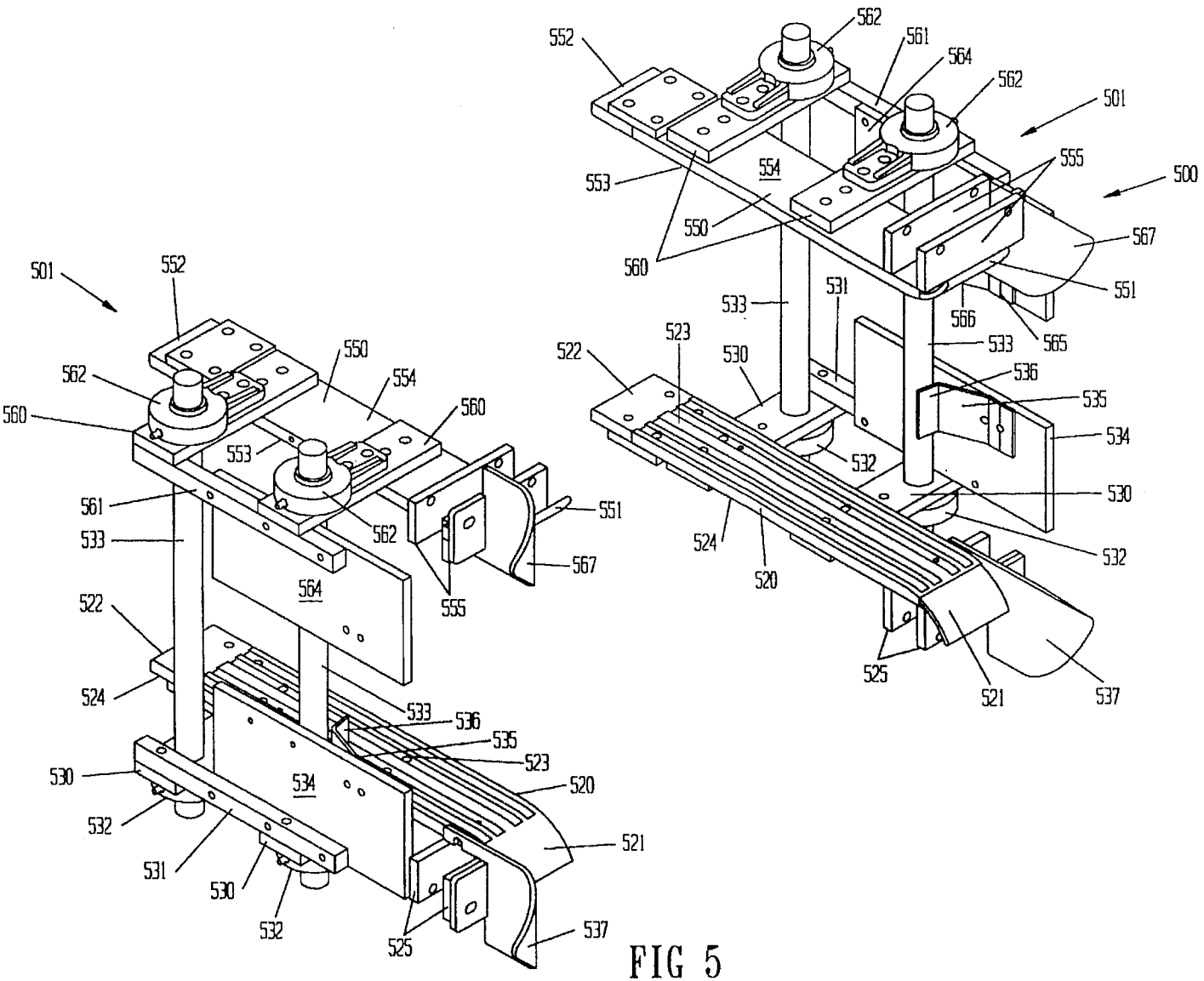
FIG. 5 is a somewhat enlarged, fragmentary perspective view of the forming assembly of the apparatus of the present invention.

A pair of bearing mounting plates 530 are mounted on the lower surface 524 of each lower ski member in predetermined spaced relation to each other and extend laterally of the forming assembly 175, as shown in FIG. 5. A cross member 531 is mounted on and interconnects the distal portions of the bearing mounting plates in spaced, parallel relation to their respective lower ski member 520. A pair of beating assemblies 532 are individually mounted on the beating mounting plates 530 so as to define vertical axes of rotation disposed in parallel relation and aligned in parallel relation to the lower ski member. Rollers 533 are individually journaled in the bearing assemblies for rotational movement about their respective vertical axes of rotation. A vertical plate 534 is mounted on the cross member 531 in upstanding relation immediately adjacent to the roller 533 nearest the entrance portion 521 of the adjacent lower ski member 520. An entrance flap 535 is mounted on the interior surface of the vertical plate adjacent to the upper edge thereof and extending obliquely rearwardly and inwardly in the general direction of the adjacent roller 533 to a free end portion 536 deployed at an angle relative to the remainder of the entrance flap 535 so as to extend obliquely across the space immediately adjacent to the roller, but not touching the roller or secured in any other respect. The entrance flap is deployed at the described angle and is sufficiently resilient so that an object entering the entrance portion 521 of the forming assembly 175 presses the free end portion 536 of the entrance flap back into contact with the roller so as to introduce the work object between the rollers 533 of the pair of subassemblies 501 for movement therebetween. Each subassembly mounts a vertical entrance plate 537 immediately adjacent to the entrance portion 521 of the lower ski member 520. As shown in FIG. 5, the vertical entrance plates have forwardly and outwardly divergent portions deployed to introduce a work object to the forming assembly.

Each subassembly 501 of the forming assembly frame 500 mounts an upper shoe or ski member 550 having an upwardly curved forward or entrance portion 551 and an opposite flat rearward or discharge portion 552. The upper ski member has a lower surface 553, preferably fabricated from a material having a low coefficient of friction, and an opposite upper surface 554. Forward mounting brackets 555 are mounted on the upper surfaces 554 of the entrance portions 551 of the upper ski members. The forward mounting brackets are mounted on the upper support bar 503 in individual vertical alignment with the respective lower ski members 520 of their respective subassemblies 501.

Bearing mounting plates 560 are individually mounted on the upper surface 554 of each upper ski member 550 and are interconnected at their distal ends by a cross member 561 mounted on the lower surfaces of the bearing mounting plates extending in right angular relation therebetween. A pair of beating assemblies 562 are individually mounted on the beating mounting plates with the upper ends of the rollers 533 individually journaled therewithin. A vertical plate 564 is mounted on the cross member 561 extending in vertical relation downwardly therefrom in alignment with the vertical plate 534 therebelow and in the space between the cross member 531 and the forward most roller 533. An entrance flap 565 is mounted on the interior surface of each vertical plate 564 in vertical alignment with the entrance flap 535 of the lower vertical plate 534. The entrance flap has a free end portion 566 having the same relationship to the forward most roller 533 of the free end portion 535 of the lower entrance flap 535. Thus, the entrance flaps of the subassemblies operate to introduce a work object between the rollers 533 of the forming assembly 175. Similarly, a vertical entrance plate 567 is mounted on the forward mounting brackets 555 curving forwardly and outwardly in alignment with its corresponding vertical entrance plate 537 therebelow serving to introduce a work object to the forming assembly. The ski members of the forming assembly are sometimes referred to herein as "first and second set of members" and as "a pair of first members" and "a pair of second members."

As previously noted, the vacuum cups 273 of the blank feeding assembly 171 are operated by a vacuum system, not shown, of any suitable type. This system employs a blower motor 575, shown in FIG. 1, having a blower motor exhaust 576.

Pneumatic System

Figure 7:
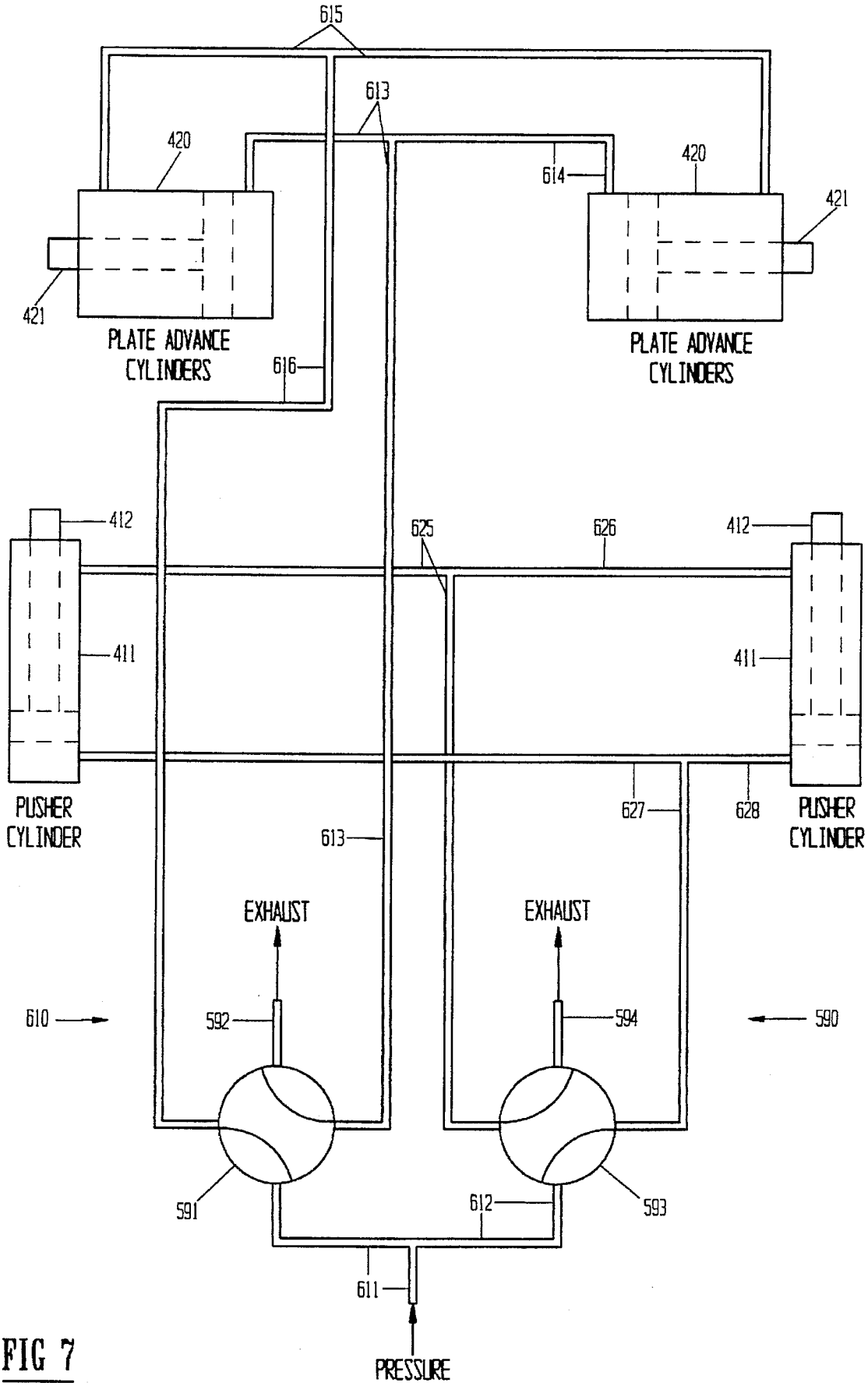
FIG. 7 is a schematic diagram of the pneumatic system of the apparatus of the present invention.

The apparatus 10 employs a pneumatic system generally indicated by the numeral 590 and shown in FIG. 7. As shown therein, the pneumatic system employs an air valve 591 having an exhaust conduit 592. Similarly, the pneumatic system has an air valve 593 having an exhaust conduit 594. The operation of the air valves is controlled by any suitable control system, not shown, of the apparatus as controlled by engagement of the cams 446 with the switches 447.

The pneumatic system has a pneumatic circuit generally indicated by the numeral 610 and shown in FIG. 7. The pneumatic circuit includes a pneumatic conduit 611 which operably interconnects a source of air under pressure and the air valve 591. A pneumatic conduit 612 interconnects the pneumatic conduit 611 and the air valve 593. A pneumatic conduit 613 interconnects the air valve 591 and the pressure side of the pneumatic cylinder 420 on the left, as viewed in FIG. 7. A pneumatic conduit 614 operatively interconnects pneumatic conduit 613 and the pressure side of the pneumatic cylinder 420 on the right, as shown in FIG. 7. A pneumatic conduit 615 operatively interconnects the cylinder arm sides of the pneumatic cylinders 420. Pneumatic conduit 616 operatively interconnects pneumatic conduit 615 and the air valve 591.

A pneumatic conduit 625 operatively interconnects air valve 593 and the cylinder arm side of pneumatic cylinder 611 on the left, as viewed in FIG. 7. Pneumatic conduit 626 operatively interconnects pneumatic conduit 625 and the cylinder arm side of pneumatic cylinder 411 on the right, as viewed in FIG. 7. Pneumatic conduit 627 operatively interconnects the pressure side of pneumatic cylinder 411 on the left, as viewed in FIG. 7, and the air valve 593. Pneumatic conduit 628 operatively interconnects pneumatic conduit 627 and the pressure side of pneumatic cylinder 411, on the right, as viewed in FIG. 7.

Any suitable electrical, control and other subsystems, not shown, can be employed for operation of the apparatus 10.

OPERATION

The operation of the described embodiment of the present invention is believed to be readily apparent and is briefly summarized at this point. While, as previously noted, the apparatus 10 is adaptable for forming a wide variety of work objects, it is uniquely well suited to forming corrugated cardboard containers, but is not to be limited thereto. More particularly, the containers 90 can be formed from the flattened container blanks 20 previously described. Accordingly, for illustrative convenience, the operation of the method and apparatus of the present invention will be described as they are employed in such usage.

The apparatus 10 is first positioned in a convenient location relative to the other equipment with which it is to be used. Thus, for example, the apparatus can be employed adjacent to an assembly line employed in packing the formed containers with commodities, such as fresh fruit, fresh vegetables, canned goods, frozen or refrigerated meat, such as poultry, and the like. Positioning of the apparatus is achieved by simply rolling the main frame 100 along the surface of support 11 on the wheel assemblies 103.

Once positioned, the blank hopper assembly 170 is filled with a plurality of the container blanks 20 stacked in side by side relation in the attitude, such as shown in FIG. 2, with respect to one of the container blanks and otherwise shown in FIG. 1. The container blanks are stacked in side by side relation with the lowermost container blank held in upright position by engagement with the blank retention blades 206 and with the lower end rested on the horizontal portion of the upper surface 186 of the ramp assembly 185.

At this time, the blank feeding assembly 171 is disposed in the attitude, shown in FIG. 2, with the vacuum cups 273 disposed in the retracted position shown therein. Similarly, the mandrel assembly 174 is disposed in the retracted position, also shown in FIG. 2, thereby leaving the delivery position 472 open to receive the container blanks fed one at a time in sequence, as will hereinafter be described. Thus, in summary, the apparatus 10 is deployed substantially, as shown in FIG. 2, as of the start up of operation thereof.

At this time the power systems, not shown, for the apparatus 10 are activated. As previously noted, any suitable electrical systems can be employed for this purpose and do not constitute part of the present invention. Similarly, any suitable control system can be used in the apparatus 10 of the present invention separate and apart from that disclosed herein.

When operation of the apparatus 10 is initiated using the control system, not shown, the blank feeding assembly 171 operates through the drive gears 246 and 247 through a drive chain, not shown, to move the linking arm 257 to draw the lever arm 250 and linkage 251 from right to left, as viewed in FIG. 2, thereby to extend the cup frame 270 and place the vacuum cups 273 in compression with the exterior surface 22 of the container blank 20 in the position shown in FIG. 2. Through the vacuum system, not shown, the vacuum cups have a negative air pressure applied thereacross to grasp the container blank. As movement of the drive gears is continued, the container blank is drawn by the vacuum cups from the retention blades 206. The negative pressure at the vacuum cups is then returned to normal pressure by the control system so as to release the container blank into the interface between the peripheries of the drive wheel 292 and idler wheel 294.

The control system, not shown, continuously rotates the drive wheel 292 in a counterclockwise direction, as viewed in FIG. 2, at a predetermined rate of speed. The container blank is thereby grasped between the drive wheel and idler wheel and driven downwardly and released into the delivery position 472 coming to a stop gravitationally by engagement of the lower edge 24 of the container blank 20 with the stop plate 471. The container blank is thus gravitationally supported in the delivery position, as shown in FIG. 2.

As previously noted, at this time, the mandrel assembly 174 is disposed in the retracted position, shown in full lines in FIG. 2, so that the bottom panel 40 of the container blank is disposed in alignment with the mandrel head assembly 330 immediately to the left thereof and the entrance opening of the forming assembly 175 disposed immediately to the right thereof, as shown in FIG. 2.

Upon the container blank reaching the delivery position, shown in FIG. 2, the control system, not shown, of the apparatus 10 operates to move the mandrel assembly 174 from the retracted position, shown in full lines in FIG. 2, along the path of travel 306 from left to right, as shown in FIG. 2, toward the bottom panel 40 of the container blank. Such movement of the mandrel assembly is controlled by the mandrel driving assembly 430 and, more particularly, by the third drive shaft 448, as previously described.

As the mandrel head assembly 330 is impelled along the path of travel 306 toward the bottom panel 40 of the container blank 20, the expansion plate assemblies 353 are disposed in their fully retracted positions shown in FIGS. 1, 3, 4A, 4B, and 6. As a consequence, as the mandrel head assembly 330 advances from left to right, as viewed in FIG. 2, the leading edges 373 of the central plates 370 of the expansion plate assemblies 353 are first to contact the container blank in the delivery position and, more particularly, the bottom panel of the container blank inwardly of the transverse edges 42 of the bottom panel 40, as can best be seen in FIG. 4A. Mandrel head assembly 330 is advanced along the path of travel into engagement with the bottom panel of the container blank from left to right, as viewed in FIG. 2, to carry the container blank against the vertical entrance plates 537 and 567 of the forming assembly 175. This causes the flaps 69 and associated corner panel 67 of the upper portion 36 of the container blank to be folded about the vertical edges 66 of the upper side panel and the end flaps 79 and associated corner panels 77 of the lower portion 37 of the container blank to be folded about the vertical edges 76 of the side panels 75 in overlapping relation, as shown in FIG. 4B.

As movement of the mandrel head assembly 330 along the path of travel is continued, the curved entrance portions 521 of the lower ski members 520 and the curved entrance portions 551 of the upper ski members 550 engage the upper side panel 65 of the upper portion 36 and the lower side panel 75 of the lower portion 37 of the container blank 20, respectively, so as to fold the lower side panel and upper side panel about the longitudinal edges 41 of the bottom panel 40 of the container blank. As movement of the mandrel head assembly is continued along the path of travel, folding along the courses indicated of the container blank continues. As the end flaps 43 contact the forward edges of the vertical plates 534, the end flaps 43 are individually folded about their respective transverse edges 42 of the bottom panel 40. After such folding of the end flaps 43 has begun about the transverse edges 42, and preferably, although not necessarily, just before the bottom panel moves between the first pair of opposed rollers, the pneumatic cylinders 420 are activated by the pneumatic system 590. This is achieved by the air valve 591 being activated by one of the cams 446. As the bottom panel 40 enters the area between the lower entrance flaps 535 and upper entrance flaps 565, the transverse edges 42 of the bottom panel 40 contact the entrance flaps and are introduced between the first pair of rollers 533 on opposite sides of the forming chamber.

This causes pneumatic pressure to be applied to the pressure sides of the pneumatic cylinders 420 through pneumatic conduits 613 and 614 to extend the pneumatic cylinder arms 420. This action causes the expansion plate assemblies 353 to be moved laterally of the mandrel head assembly 330 to the positions shown in FIG. 4C. This movement causes the expansion plate assemblies to engage the end flaps 69 driving them outwardly against the end flaps 79 and folding the end flaps 69 about vertical edges 68 of the corner panel 67 so as to deploy the corner panels 67 in the oblique or beveled positions or oblique attitudes shown in FIG. 4C. The rollers 533 offer resistance to further outward movement of the end flaps 43, 69 and 79 so that the corner panels 77 are folded along vertical edges 78 so as to form the oblique or beveled corner panels shown in FIG. 4C. The end flaps 69, 79 and 43 are compressibly held between the rollers 533 and the expansion plate assemblies during continued movement of the mandrel head assembly toward the fully extended position, wherein the container blank has been completely folded into the configuration shown in FIG. 4C. Since the end flaps 69, 79 and the end flaps 43 are compressibly held in engagement, the adhesive applied along predetermined courses previously referred to is permitted adhesively to retain the container blank in the configuration shown in FIG. 4C, thus, forming the erected container 90 as shown therein. Thus, it will be seen that the manipulating assembly has transverse dimensions interactive with the form to form the erected container 90. The outer surfaces of the container are sometimes referred to herein as "predetermined surfaces" and "predetermined portions".

As the container 90 reaches the extended position within the forming assembly 175, the compressive engagement of each expansion plate assembly 353 and the rollers 533 cause the end flaps 43, 69 and 79 to be drawn toward or into precise overlapping engagement in the arrangement shown in FIG. 4C. However, to ensure that the lateral edges 70 and 80 of the end flaps 69 and 79, respectively, are in alignment with the end edge 56 of the end flap 43, the pneumatic system 590 operates the pneumatic cylinders 411 to extend the pneumatic cylinder arms 412 by operation of the air valve 593 supplying air under pressure through the pneumatic conduits 627 and 628 to the pressure sides of the pneumatic cylinders 411. This causes the pressure plates 398 to be advanced toward, and into, engagement with the lateral edges 70, 80 and 56 pushing them into precise alignment defining a plane extending in fight angular relation to the direction of travel as the mandrel head assembly 330 and the container 90 so formed reach the extended position within the forming assembly 175. This ensures that the container, so formed, is in each instance of the precise configuration desired and as shown in FIG. 4C.

Subsequently, the pneumatic system 590 again operates the air valve 591 to apply air pressure to the cylinder arm sides of the pneumatic cylinders 420 along pneumatic conduits 616 and 615 permitting air to escape from the pressure sides of the chambers of the pneumatic cylinders along pneumatic conduits 613 and 614. Thus, the pneumatic cylinder arms 421 are retracted so as to move the expansion plate assemblies 353 to the fully retracted positions previously identified and, for example, shown in FIG. 6. This releases the container 90 within the forming chamber of the forming assembly 175 and permits the mandrel assembly 174 to be withdrawn from the forming chamber and from the container so formed therewithin by the mandrel driving assembly 430 to the retracted position 464 shown in FIG. 2.

As the mandrel assembly 174 is moved to the retracted position, the air valve 593 is operated by the control system to release air pressure from the pressure sides of the pneumatic cylinders 411 along pneumatic conduits 627 and 628 and to apply air pressure to the non pressure sides of the pneumatic cylinders through pneumatic conduits 625 and 626. This causes the pneumatic cylinder arms 412 to be withdrawn to the retracted positions and retracts the pusher plates 398 to their respective retracted positions for repetition of the cycle in the formation of the next container 90 from the container blank 20 as previously described.

This forming process previously described with the method and apparatus of the present invention is thus repeated with the next successive container blank 20. As the process continues and the container blank is driven into the forming assembly 175, the bottom panel 40 engages the container 20 previously formed and resting in the extended position within the forming assembly. As movement of the mandrel assembly 174 continues to the extended position, the container previously formed is ejected from the forming assembly 175 through the discharge opening 499 thereof, as can best be visualized in FIG. 2.

Therefore, the method and apparatus of the present invention have particular utility in the formation of containers; possess the sensitivity, dexterity and speed required in the formation of cardboard containers of more sophisticated design than has heretofore been possible on a commercially practical basis; have the capability of erecting cardboard containers from container blanks of a flattened configuration operating to receive the blanks, fold the blanks into a predesignated configuration; are unusually well suited to the formation of containers to be employed in the packing and shipment of commodities which are relatively heavy, bulky, or irregularly shaped so that the packed container forms a more unitary mass less susceptible to collapse or other damage; and are otherwise entirely successful in achieving their operational objectives.

Although the invention has been herein shown and described in what is conceived to be the most practical and preferred embodiments, it is recognized that departures may be made therefrom within the scope of the invention which is not to be limited to the illustrative details disclosed.

Having described our invention, what we claim as new and desire to secure by Letters Patent is:

1. A method for forming a container or the like comprising the steps of moving the container, initially disposed in a substantially planar first configuration as a blank, along a path of travel to a forming position; defining an outer boundary for the container disposed in a second configuration as a container, substantially about said forming position and defined by a forming chamber and wherein, in said second configuration, the container has predetermined side walls and end walls interconnected by corner panels substantially obliquely interconnecting adjoining side walls and end walls; and expanding the container substantially laterally of the path of travel after the container has at least partially entered said forming chamber, during said moving of the container along the path of travel to dispose the container in said second configuration in said forming position including moving adjoining side walls and end walls from each other, during said moving of the container into the forming chamber, and into engagement with said outer boundary so as to obliquely dispose said corner panels extending therebetween in said second configuration as a container.

2. The method of claim 1 in which at least one of said side walls or end walls of the container in said second configuration is composed of a plurality of panels which, in said second configuration, are disposed in predetermined facing engagement having trailing edges positioned so as substantially to define a plane of reference substantially right-angularly related to the path of said moving of the container into the forming chamber and including the step of pushing said trailing edges along courses substantially parallel to said path of moving, as the container is disposed in the second configuration, to urge said trailing edges into positions in said second configuration substantially defining said plane of reference.

3. An apparatus for forming a container or the like comprising means for delivering said container, disposed in a first configuration, to a delivery position; a forming assembly adjacent to said delivery position defining a form dimensioned to receive the container therewithin disposed in a second configuration having predetermined side walls and end walls interconnected by oblique corner panels; and a manipulating assembly operable to engage the container in said delivery position and to transport the container into said form to manipulate the container from the first configuration to the second configuration moving said side walls and end walls into engagement with the form with said corner panels extending obliquely therebetween.

4. The apparatus of claim 3 wherein said manipulating assembly is movable along a predetermined path of travel through the delivery position and into said form in manipulating the container from the first configuration to the second configuration.

5. The apparatus of claim 4 wherein said manipulating assembly has a head having transverse dimensions interactive with said form, in moving along said path of travel to an extended position within the form, to manipulate the container into said second configuration.

6. The apparatus of claim 5 wherein the head of the manipulating assembly has secondary portions which individually move substantially laterally of the head, during movement of the manipulating assembly along the path of travel to said extended position, to engage predetermined surfaces of the container, after at least partial entry of the container into said form and before reaching said extended position, to manipulate the container into said second configuration upon said extended position being reached.

7. The apparatus of claim 6 wherein said form of the forming assembly has portions defining the outer boundary of the container in said second configuration thereof and said secondary portions of the head engage said predetermined surfaces of the container before reaching said extended position to manipulate said container into said second configuration having predetermined portions inwardly spaced from said outer boundary.

8. The apparatus of claim 7 in which said predetermined surfaces of the container are individual surfaces of a plurality of panels which, in said second configuration, are disposed in predetermined facing engagement having trailing edges positioned so as substantially to define a plane of reference substantially right-angularly related to said path of travel and wherein the manipulating assembly has members movable along courses substantially parallel to said path of travel, as the head approaches said extended position, to engage said trailing edges of the container to urge the trailing edges into positions in said second configuration substantially defining said plane of reference.

9. The apparatus of claim 8 including means for applying adhesive to said panels, prior to the container being manipulated into the second configuration, thereby to retain the plurality of panels in said predetermined facing engagement once the container is manipulated into said second configuration and thereby maintaining the container in the second configuration.

10. The apparatus of claim 8 wherein said container has fold lines extending substantially along predetermined courses substantially along which the container is folded, during movement of the head of the manipulating assembly along the path of travel to the extended position, to cause the container to be manipulated into the second configuration during said movement.

11. The apparatus of claim 8 including a pneumatic system operable to move said secondary portions substantially laterally of the head during movement of the manipulating assembly along the path of travel.

12. An apparatus for forming containers from container blanks, individually having fold lines along which each container blank is adapted to be folded to form a predetermined bottom panel, opposite side panels, opposite end panels and corner panels, obliquely interconnecting adjacent end panels and side panels, to form a container having substantially beveled corners, the apparatus comprising:

A. a main frame operable individually to receive each container blank in a delivery position;

B. a forming assembly mounted on the main frame on a first side of said delivery position and having a first set of members spaced from each other for substantially sliding engagement with the container blank so as to fold the container blank to form said opposite side panels and a second set of members spaced from each other and substantially right-angularly related to the first set of members for substantially sliding engagement with the container blank so as to fold the container blank to form said opposite end panels, said first and second set of members bounding a forming chamber having an entrance opening substantially facing said delivery position;

C. a mandrel assembly, having a head portion, mounted on the main frame on a second side of the delivery position for substantially reciprocal movement along a predetermined path of travel through the entrance opening into and from said forming chamber of the forming assembly to carry the head portion thereof to and from a predetermined extended position within the forming chamber and thereby individually to carry the container blank from the delivery position into said forming chamber;

D. expansion members mounted on opposite sides of the head portion of the mandrel assembly for movement from the head portion substantially laterally of said path of travel subsequent to said transport of the head portion, and thereby the container blank, into the forming chamber to move the end panels of the container blank from the side panels of the container blank into engagement with the forming assembly and thereby to move the corner panels into said oblique attitudes interconnecting adjacent end panels and side panels to form said container having substantially beveled corners; and E. means for retaining said container in the form having substantially beveled corners.

13. The apparatus of claim 12 wherein the head potion of the mandrel assembly is movable along said path of travel between said extended position and a retracted position spaced from the entrance opening of the forming chamber and including means for transporting said container blanks, individually disposed in substantially flattened conditions, in sequence to the delivery position between said head portion of the mandrel assembly, while in said retracted position, and said entrance opening of the forming chamber for engagement by the head potion of the mandrel assembly, in movement along the path of travel to said extended position and with said head portion in engagement with the bottom panel of the container blank to transport the container blank to said extended position within the forming chamber of the forming assembly to form said container about said head portion within the forming chamber.

14. The apparatus of claim 13 Wherein said expansion members are moved from the head portion substantially laterally of said path of travel prior to the container blank reaching the extended position to form said container having substantially beveled corners.

15. The apparatus of claim 13 wherein said first set of members of the forming assembly includes a pair of first members disposed for said substantially sliding engagement with each side panel of the container and individually having lateral edges substantially individually aligned with the lateral edges of their respective side panel and wherein said second set of members of the forming assembly includes a pair of second members disposed for said substantially sliding engagement with each end panel of the container spaced from said lateral edges of their respective adjacent side panels a distance substantially equal to the distance between the outer surface of its respective adjacent end panel and the corner panel extending therebetween in said container so formed.

16. The apparatus of claim 15 wherein said pair of second members are rollers individually mounted on the forming assembly for substantially rotational movement about substantially vertical axes for both rotational and sliding movement by engagement with their respective end panels of the container blank during said movement of the container blank to the extended position within the forming chamber.

17. The apparatus of claim 16 including at least a pair of plates mounted on the forming assembly adjacent to opposite sides of said entrance opening of the forming chamber, inwardly convergent of the forming chamber therefrom and individually having free end portions resiliently engageable With the adjacent rollers of each pair or rollers for introduction of the bottom panel of the container blank between the pairs of rollers during movement of the container blank from said delivery position to said extended position.

18. The apparatus of claim 17 wherein said end panels of the container so formed are individually composed of a plurality of subpanels of the container blank and at least a pair of plates are individually mounted on the forming assembly on opposite sides of the entrance opening of the forming chamber outwardly divergent therefrom for engagement by said subpanels of the container blank during said movement of the container blank from said delivery position to said extended position.

19. The apparatus of claim 13 wherein said expansion members have substantially flat plates mounted on the head portion of the mandrel assembly for movement through positions of substantial parallelism to each other in opposite directions substantially laterally of said path of travel.

20. The apparatus of claim 19 in which said container so formed has a substantially predetermined depth and wherein said substantially flat plates of the expansion members have dimensions along courses substantially parallel to said path of travel substantially equal to or greater than said predetermined depth of the container.

21. The apparatus of claim 20 wherein said substantially flat plates individually mount face plates fabricated from a material having a low coefficient of friction for substantially sliding engagement with the end panels of the container blank.

22. The apparatus of claim 21 in which the opposite end panels of said container so formed have substantially predetermined lengths, extending between said adjacent corner panels and wherein said substantially flat plates of the expansion members have dimensions along courses substantially right-angularly related to said path of travel substantially not greater than said predetermined lengths of the opposite end panels.

23. The apparatus of claim 22 wherein said second set of members of the forming assembly are rollers mounted on the forming assembly for substantially rotational engagement with the opposite end panels as the container blank is moved to said extended position.

24. The apparatus of claim 23 wherein the substantially flat plates of the expansion members are moved through said positions of substantial parallelism from retracted positions to expanded positions after the head portion of the mandrel assembly has entered the entrance opening of the forming chamber and before reaching said extended position whereby the container blank is first folded between the lateral edges of said bottom panel and their respective adjacent corner panels between the head portion of the mandrel assembly and the forming assembly and then folded between said corner panels and their respective end panels by said movement of the substantially flat plates of the expansion members from said retracted positions to said expanded positions to capture said end panels between the respective rollers and substantially flat plates in engagement therewith during movement to said extended position.

25. The apparatus of claim 24 wherein said opposite end panels of the container so formed are each composed of a plurality of subpanels of the container blank and wherein said forming assembly mounts means adjacent to said entrance opening of the forming chamber for engaging said subpanels of the container blank in a predetermined sequence to fold said subpanels in a predetermined, interleaved relationship to form said end panels.

26. The apparatus of claim 25 including means borne by said main frame for applying adhesive to the subpanels of each container blank at least as of the receipt of each container blank in the delivery position and wherein said subpanels of each end panel of each container blank are captured between their respective expansion member and said rollers upon the mandrel assembly reaching said extended position adhesively to unite the subpanels of each end panel to retain said container blank in the configuration so formed.

27. The apparatus of claim 26 wherein each substantially flat plate of the expansion assembly is mounted on the mandrel assembly by at least one shaft slidably interconnect with a sleeve and including a pneumatic system operably connected to each substantially flat plate for movement thereof through said positions of substantial parallelism as guided by said shaft slidably interconnected with the sleeve.

28. The apparatus of claim 27 wherein a pair of alignment assemblies mounted on the mandrel assembly including a pair of plates disposed substantially to define a plane of reference right-angularly related to said path of travel, means for moving said plates along secondary paths of travel individually outwardly of said expansion assemblies and substantially parallel to said path of travel of the mandrel assembly from retracted positions withdrawn from the direction of movement of the mandrel assembly along the path of travel thereof to extended positions advanced relative to said direction of movement for engagement with trailing edges, relative to said direction of movement, of said subpanels of the end panels in said extended position of the mandrel assembly for adjustment of the trailing edges of the subpanels of the respective end panels into substantial alignment with said plane of reference defined by the plates of the alignment assemblies.

29. The apparatus of claim 28 including means for sequencing the apparatus whereby each container blank is delivered to said delivery position when the mandrel assembly is in said retracted position, the mandrel assembly is then moved along said path of travel toward said extended position to carry a container blank from the delivery position into the entrance opening of the forming chamber of the forming assembly, after folding of the corner panels of the container blank relative to the bottom panel thereof said expansion assemblies are moved to their respective expanded positions to fold the subpanels of the end panels thereof relative to the respective adjoining corner panels thereof and thereafter the pair of plates of the pair of alignment assemblies are moved to their respective extended positions to form said end panels and, thereby, the container.

30. The apparatus of claim 29 wherein said forming chamber of the forming assembly has a discharge opening remote from said entrance opening substantially aligned with said path of travel of the mandrel assembly whereby, subsequent to the formation of one of said containers at the extended position of the mandrel assembly, the apparatus is operated to repeat said forming operation with the next successive container blank received in said delivery position so that the prior container so formed is ejected from the forming assembly through said discharge opening by engagement by said subsequent container blank moved by the mandrel assembly toward said extended position along the path of travel of the mandrel assembly.

* * * * *

UNITED STATES PATENT AND TRADEMARK OFFICE

CERTIFICATE OF CORRECTION

PATENT NO. : 5,656,006

DATED : August 12, 1997

INVENTOR(S) : Blaine D. East, et al.

It is certified that error appears in the above-identified patent and that said Letters Patent is hereby corrected as shown below:

Column 4, line 53, delete "fight" and substitute ---right---;
Column 4, line 65, delete "fight" and substitute ---right---;
Column 5, line 7, delete "39" and substitute ---59---;
Column 5, line 42, delete "fight" and substitute ---right---;
Column 6, line 22, delete "fight" and substitute ---right---;
Column 6, line 27, delete "fight" and substitute ---right---;
Column 7, line 57, between "plate" and "and", insert ---227---;
Column 8, line 55, delete "beating" and substitute ---bearing---;
Column 9, line 5, delete "beating" and substitute ---bearing---;
Column 9, line 20, delete "beating" and substitute ---bearing---;
Column 9, line 45, delete "therewith." and substitute ---therewithin.---;
Column 9, line 47, between "assembly" and "353", insert ---, expansion member or secondary portion---;
Column 12, line 52, delete "beating" and substitute ---bearing---
Column 12, line 53, delete "beating" and substitute ---bearing---
Column 13, line 31, delete "beating" and substitute ---bearing---
Column 13, line 32, delete "beating" and substitute ---bearing---
Column 17, line 14, delete "fight" and substitute ---right---;
Column 20, line 26, delete "potion" and substitute ---portion---;
Column 20, line 35, delete "potion" and substitute ---portion---;
Column 20, line 42, delete "Wherein" and substitute ---wherein---

UNITED STATES PATENT AND TRADEMARK OFFICE

CERTIFICATE OF CORRECTION

PATENT NO. : 5,656,006

DATED : August 12, 1997

INVENTOR(S) : Blaine D. East, et al.

It is certified that error appears in the above-identified patent and that said Letters Patent is hereby corrected as shown below:

Column 21, line 6, delete "With" and substitute ---with---;

Signed and Sealed this

Seventeenth Day of March, 1998

Bruce Lehman

*Attest:*

BRUCE LEHMAN

*Attesting Officer*

*Commissioner of Patents and Trademarks*